United States Patent [19]

Hair et al.

[11] 3,946,537

[45] Mar. 30, 1976

[54] APPARATUS FOR FORMING AND CLOSING A DISPLAY PACKAGE

[75] Inventors: George R. Hair, Clifton; Albert Agostinelli, Paterson, both of N.J.

[73] Assignee: New Jersey Electronic Co., Clifton, N.J.

[22] Filed: June 10, 1974

[21] Appl. No.: 478,179

[52] U.S. Cl. ..... 53/184; 53/329 R

[51] Int. Cl.[2] ..... B65B 47/02; B65B 47/10

[58] Field of Search ..... 53/30, 184, 329

[56] References Cited

UNITED STATES PATENTS

| | | | |
|---|---|---|---|
| 3,075,329 | 1/1963 | Swezey et al. | 53/184 |
| 3,075,330 | 1/1963 | Swezey | 53/184 |
| 3,113,345 | 10/1963 | Butzko | 425/292 |
| 3,195,284 | 7/1965 | Crane | 53/30 |
| 3,195,284 | 7/1965 | Crane | 53/30 |
| 3,657,857 | 4/1972 | De Woskin et al. | 53/184 X |

*Primary Examiner*—Travis S. McGehee
*Attorney, Agent, or Firm*—H. Hume Mathews

[57] ABSTRACT

An apparatus for forming and closing a display package comprises a card blank and an overlying plastic sheet and includes a carrier for the blank and the overlying plastic which is movable through an operation path. The carrier advantageously comprises a rotatable plate having a plurality of receiving areas for individual cards and plastic sheets which are arranged at spaced annular locations on the table and which may be rotated through the operational path by rotation of the table. Associated with the operational path of movement is a device for feeding either individual cards with window openings or cards which already have plastic sheets affixed thereto onto the associated carrier. The plastic sheets may be fed separately, if desired, so that they will overlie the card blank. A heat sealing and forming device is arranged along the operational path and engages the plastic sheet to heat it and to form it into a pocket and this is advantageously accomplished when the carrier is held stationary. The carrier is rotated further through an operational path intersecting a loading or product filling station or stations where the pockets may be filled with articles. Subsequently, as the carrier is moved, folding means engage the card to fold it during the movement of the carrier so that a portion thereof overlies the remaining portion having the window. At the end of this movement, the card is positioned to be contacted by sealing means for sealing the card with the pocket. The inventive method includes feeding the cards into a carrier and either separately or coincidentally feeding a plastic sheet thereover, then moving the card into association with forming means for forming the pocket. The forming means advantageously forms pockets on each side of a central folding line so that, when the card is folded, the pockets overlie each other. The card with the pockets is then advanced into a location at which it may be filled with articles, and then it is folded as it is moved into association with sealing means and carried away.

13 Claims, 15 Drawing Figures

APPARATUS FOR FORMING AND CLOSING A DISPLAY PACKAGE

BACKGROUND OF THE INVENTION

1. Field of the Invention

This invention relates in general to a method and apparatus for forming and closing display packages from a card blank having a window opening in an overlying plastic sheet thereon which includes means for forming a pocket of the plastic sheet, filling the pocket with an article, folding the card to close the pocket and subsequently sealing the pocket with the card.

2. Description of the Prior Art

At the present time, there are many types of machines for forming and filling display packages. In one known type, a rotatable carrier table for a card blank is positioned in sequence into association with apparatus for heating and forming a pocket, filling the formed pocket, closing the formed pocket by folding the blank carrying the pocket at a fixed station and, thereafter, moving the folded and closed blank into association with sealing means for sealing it closed. A disadvantage in the known machine structure is that the table carrier for the card must be indexed and stopped at each of a multitude of stations at which an operation is carried out. This necessarily means that the driving mechanism for the carrier must be such that it permits indexing motion and stopping of the carrier for each operation. The known drive mechanisms which are operable thus require, for example, a separate station heating the plastic sheet and also for forming a pocket in the heated sheet as well as separate stations for sealing the package and for subsequently removing it from the machine. Therefore, such a machine must be of very large size and require a great amount of time in passing the card through operational paths and stopping them at each location in order to effect the formation and filling of the display card pocket. Attempts have been made to construct machines of this character which will operate at extremely high speeds but all of them require a stopping of the operation while the individual package forming apparatus operate on a card blank and plastic sheet. The disadvantage in the known constructions is that not only the heating and forming operations and sealing operations are performed at separate fixed stations, but also, the auxiliary operation of folding is carried out while the machine is temporarily stopped. The reason for this is that the known devices for automating the machine completely so that it operates continuously as the formations are made are very expensive to manufacture and difficult to operate.

SUMMARY OF THE INVENTION

The present invention provides an improvement over the known devices inasmuch as it provides a machine which is of very simple construction, economical to operate, uses less floor space and which provides a means for folding the card blank in order to position one part of the card so that it overlies another part containing the window and pocket while the card is being moved between a station at which it is loaded with articles and one in which it is sealed. The inventive machine may be made much smaller than the known devices inasmuch as two or more operations are carried out at a single station or when the machine is moving. By the simple provision of an automatic folder arranged along the operational path of movement of the card, it is possible to initially fold one half of the card upwardly during a portion of the movement until the upwardly folded part is contacted by a plow which folds it downwardly over the other part. With this simple mechanism, it is possible to run the card forming and filling operation and subsequent sealing very rapidly without waiting for the hand folding of the card as in the previous operations. This simple arrangement provides a vastly increased range of operation of the machine and at much higher speeds than known heretofore and without requiring very large additional expenditure.

The invention includes a rotatable table carrier having a plurality of angularly spaced card blank holders around its periphery and it is connected to a driving mechanism to effect a continuous indexing movement through an operational path. Along the operational path is a mechanism for feeding cards in succession into the holders of the carrier table and plastic sheets may be either fed with the card or separately at a separate angular position of the respective holder of the carrier table. The table is moved in an indexing movement so that the carrier holder is eventually positioned in alignment with plastic pocket forming means which operate on the plastic after it is heated through pressure control elements to form it into a pocket and preferably four pockets on a single card are arranged in pairs on each side of a fold line.

After passing the forming station, the card blank with the formed pockets arrives at an article loading station which may be either automatically operated or manually operated. The operator or the article packing machine need only deposit the articles in the outermost two pockets and thereafter, an automatic mechanism is effective to lift up the other side of the card containing the other two pockets and to proceed to fold the card as the carrier table is moved so that it is completely folded one part above the other with the pockets being in alignment at the time that it reaches a location adjacent a sealing mechanism arranged along the operational path. The sealing mechanism includes a mechanism associated therewith for lifting the completed package out of the sealing dies and transmitting them to a product discharge chute during indexing of the machine.

A further feature of the invention is that the carrier table may be provided with either four or six stations. In each type of station machine, one of the very important operations, that is, the folding of the card to effect the covering of the pocket, is carried out automatically during the movement of the card between two of these stations. In a four station machine, the card is fed at one and the plastic pocket is formed at another and thereafter, the product is loaded at a distinct station and fed to a separate station for sealing and take off. In a six station arrangement, this may be varied by feeding the film separately from the cards at a separate station and by loading the product at two station positions. Still another arrangement is to provide for a card feed, the forming, the product loading, the sealing and to have a separate station for the take off of the card. In this arrangement, two stations may also be provided for product loading.

The machine of the invention may be operated intermittently to produce a frame view blister package or a stand up blister package which is either one-sided or see-through. The drive for the operating mechanism advantageously comprises an electric motor which drives through a gear reducer to the input of a single revolution clutch. The output of the clutch is connected to operating mechanism for effecting the various movements of the individual forming apparatus which are arranged along the operations path of movement of the card blank holder of the carrier table. The drive may be the same for a six station operation in which case, a Geneva drive in the mechanism, having six positions, is substituted for one having four positions. The device may produce a blister package or a flexible package in either a four or six station machine. In the preferred arrangement, the system for feeding cards into the holders on the carrier table, as well as the system for lifting the finished cards or packages upwardly from the packing table, are mechanically driven. Therefore, accurate timing of these systems with the indexing of the carrier table is easily effected. The heat seal mechanism for sealing the cards is effective to seal either the top of the card alone or the top and bottom simultaneously. The sealing is advantageously carried out by a high frequency generator, or a so-called RF generator, in which the power supply or the oscillator sections can be removed and replaced by plugging in.

A further advantage of our machine is that the forming of the pockets is carried out with the aid of vertically moveable lower platens which are raised by cams instead of air cylinders. This permits the cooperative top platens to start down at the same time that the lower platens start upward because of the better timing experienced with mechanical cam drives. Also, since less air cylinders are used the air requirements are fewer, and the machine is simpler to set up and adjust.

The inventive method comprises moving a card blank having at least one window opening with a plastic sheet overlying the window opening through an operating path, stopping the movement of the card through the path and forming a pocket in the plastic sheet, advancing the cards through the path once again, and filling the formed pocket with an article, continuing to advance the card with the article in the pocket and folding it while it is advanced so that one part of the card overlies the other part having the window, and sealing the folded card and pocket.

A further object of the invention is to provide an apparatus for forming and closing a display package which is simple in design, rugged in construction an economical to manufacture.

The various features of novelty which characterize the invention are pointed out with particularity in the claims annexed to and forming a part of this disclosure. For a better understanding of the invention, its operating advantages and specific objects attained by its used, reference should be had to the accompanying drawings and descriptive matter in which there are illustrated preferred embodiments of the invention.

DESCRIPTION OF THE PREFERRED EMBODIMENTS

Figure 1:
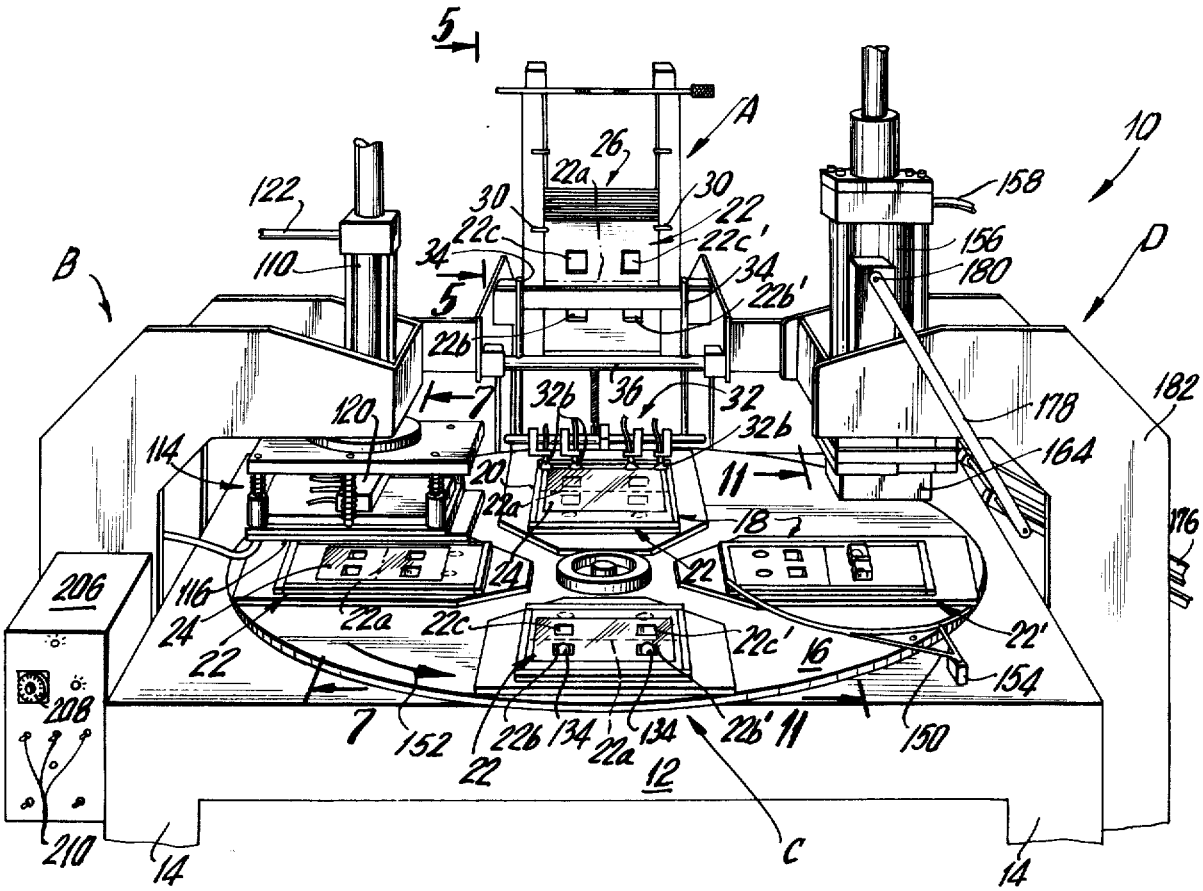
FIG. 1 is a front top perspective view of apparatus for filling, forming and closing a display package constructed in accordance with the invention.
Figure 2:
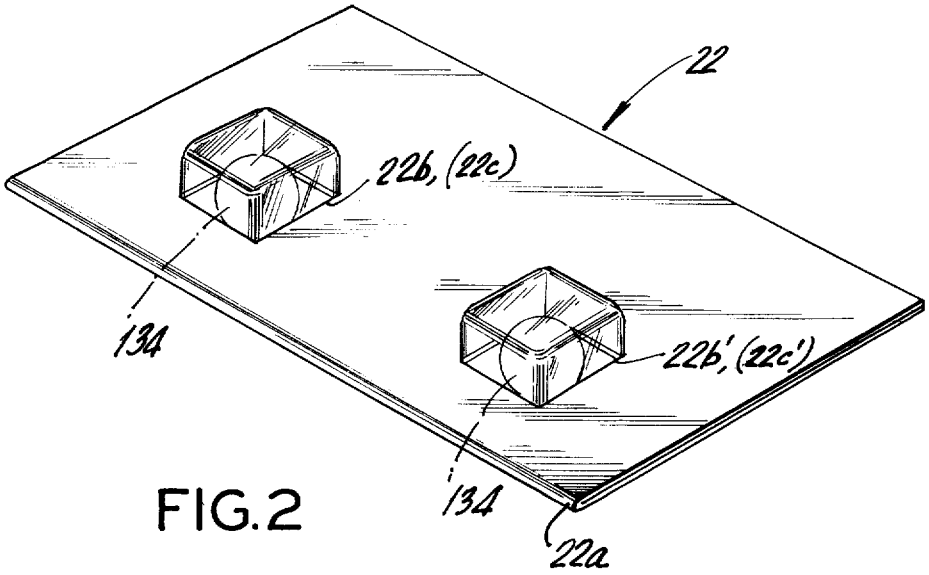
FIG. 2 is a top plan view of a folded double-frame view blister package which may be either one-sided or see-through, as constructed in accordance with the invention.

Referring to the drawings in particular, the invention embodied therein in FIGS. 1 through 12 comprises an apparatus for forming, filling and closing a display package or blister-packaging machine, generally designated 10, which includes a machine frame 12, having legs 14 for supporting a table height, for example. The frame 12 provides means for rotatably supporting a rotatable carrier table 16, having a plurality of carrier holders 18 arranged at spaced annular locations on its top surface. Each carrier holder comprises a centering frame portion 20 of a size to receive a card blank 22 therein. The card blank, generally designated 22 and as best shown in FIG. 2, comprises a single sheet of a relatively stiff material which, before it is folded over as shown in FIG. 2, is provided with a central score line or fold line **22*a* arranged centrally between pairs 22*b* and 22*c* of window openings arranged on respective sides of the fold line 22*a*. Each card is preferably covered by a plastic sheet 24 which is of a size which is large enough to cover all of the four separate window openings 22*b*, 22*c*, and 22*b*', 22*c*'. The table carrier 16 is rotated to move the holders 18 through an operating path in order to present the cards 22** and the plastic sheet into association with various operating mechanisms.

Figure 5:
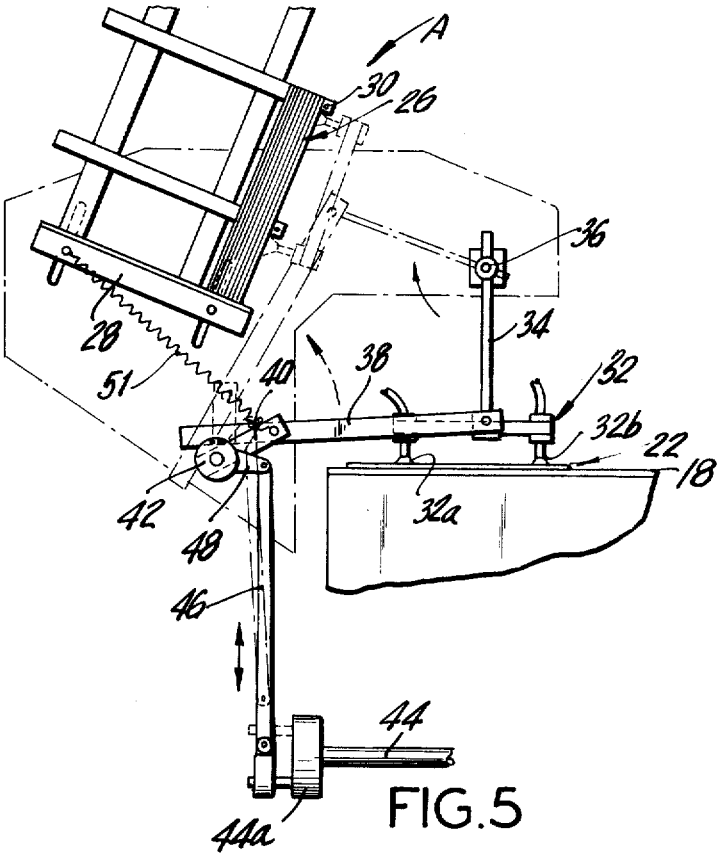
FIG. 5 is a section taken along the line 5—5 of FIG. 1.
Figure 6:
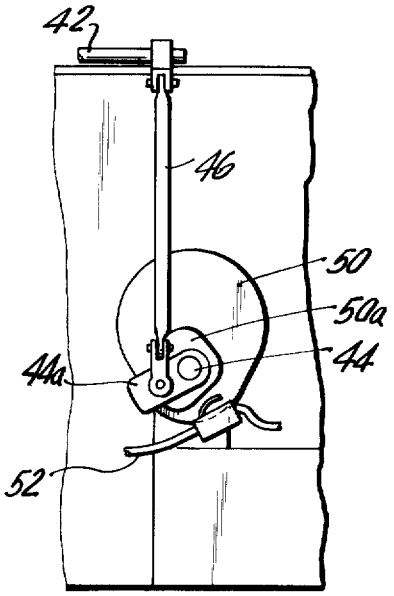
FIG. 6 is a partial side elevational view of the mechanism shown in FIG. 5.

In the embodiment of the invention shown in FIG. 1, a card loading mechanism, generally designated A feeds individual cards 22 from a stack of cards 26 which are placed on an inclined bottom 28 of the card feeding mechanism A. The cards feed by gravity along the bottom 28 until they move against side abutments 30. Each card in succession is engaged by a gripper assembly 32 including grippers **32*a* and 32*b*, and which is pivoted on a rod 34 which in turn is rotatable on a pivot shaft 36 as shown in FIGS. 5 and 6. Rod 34 and gripper assembly 32 are connected by a connecting link 38 which is carried on shaft 42. Shaft 42 is operated by a cam shaft 44 through a connecting rod connection 46** to a crank arm 48 on shaft 42. A spring 51 stores energy when the card feeder moves to a feed position and thereafter it biases connecting link 38 to move backwardly toward the stack 26 and in so doing, the grippers 32*a* and 32*b* are pivoted around so that they engage against the first card at the end of the stack and lift it off the stack. The feeder is driven by shaft 44 which in turn drives 44*a* on end of shaft 44 in turn moves connecting link 46 which in turn drives crank 48 which oscillates shaft 42. Arm 38 (fixed on shaft 42) then moves through the same angular displacement as crank 48. Thus, as arm 38 turns counterclockwise, the energy stored in spring 51 will assist the mechanism and so some of the work required. In the forward motion, the grippers reverse themselves to the solid line position indicated in FIG. 5 and deposit the card 22 on the carrier holder 18. The cam shaft 44 also carries a cam 50*a* which during rotation operates on a conduit 52 for regulating the supply of a suction connection to the suction cups 32*a* and 32*b*.

At the feeding station A, a card 22, along with a plastic sheet 24, are either separately fed or placed within the frame 20 of carrier holder 18, or the plastic is previously joined to the card and the two of them are fed together. After a card is deposited in frame 20, table 16 is rotated to move the first carrier holder 18 with card 22 into association with a forming mechanism, generally designated B, for forming pockets in the plastic sheet at the location of the windows 22*b*, 22*c*, 22*b'* and 22*c'*.

Figure 3:
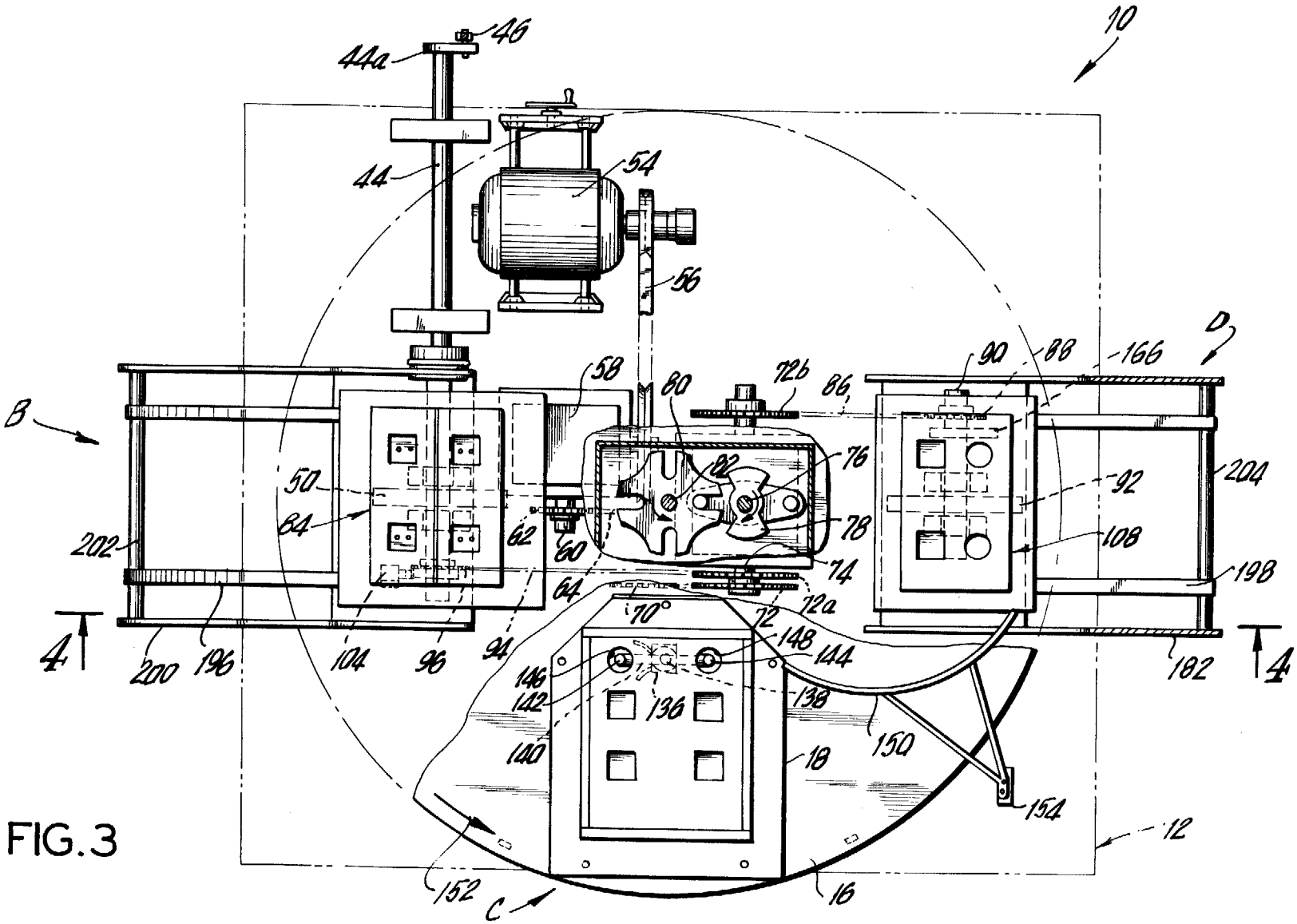
FIG. 3 is a partial top plan and sectional view of the machine shown in FIG. 1 with part of the rotary carrier table being shown.

The rotation of the drive table 16 is effected by a drive mechanism which includes, as best shown in FIG. 3, a main drive motor 54 which drives through a belt 56 to a speed reducer 58 which has an output shaft 60 which rotates continuously and which contains a sprocket 62 which drives through a chain 64 to a sprocket 66a which is behind sprocket 66 on a shaft 68. A clutch (not shown) is located between sprockets 66 and 66a. The sprocket 66 is connected through a chain 70 to drive a sprocket 72 of an input drive shaft 74. Drive shaft 74 is connected through gearing to a vertical shaft 76. Vertical shaft 76 contains a Geneva drive mechanism 78 which drives a Geneva cross 80 which is affixed to a shaft 82 which, in turn, is affixed to table 16. The Geneva drive indexes the table 90° during each motion period so that each carrier holder 18 is indexed through an operation path bringing it past the card feeding mechanism A, the forming mechanism B, the product loading station, generally designated C and a package sealing and lift-off mechanism generally designated D. (See FIGS. 3 and 4). The Geneva drive mechanism includes means to allow the input to move through the first 45° while the output is locked. During this period the heating and forming platen or mold 84 of the forming mechanism B is dropped, as is seal platen 108. The input to the Geneva drive mechanism then engages the output while it is advanced through the next 90°, thus indexing the output 90°. Then as the input to the Geneva drive mechanism advances a further 45° the output is again locked while the platens 84 and 108 are raised to a position to operate on the card blanks 22.

Figure 4:
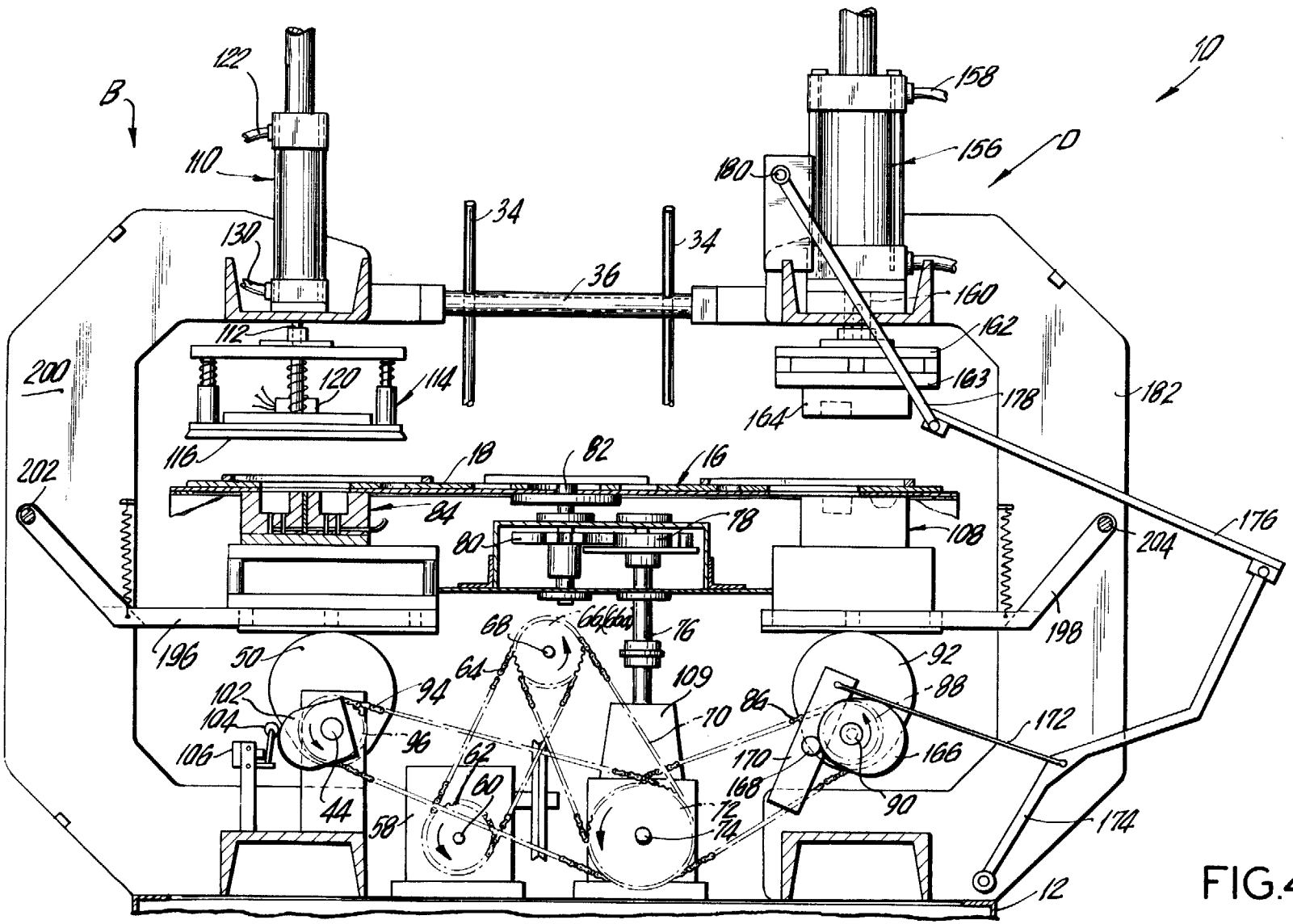
FIG. 4 is a section taken along the line 4—4 of FIG. 3.

A drive sprocket 72b on the shaft 74 along with sprocket 72 is connected through a chain 86 to a sprocket 88 of a shaft 90 which contains a lift cam 92 as shown in FIG. 4. A similar chain 94 extends to a sprocket 96 of a shaft 44 which contains a lift-off cam 50. Cam shaft 44 also carries a cam 102 which is engaged by a follower 104 of a microswitch 106 which is connected to a timer (not shown) which is connected to a single revolution clutch carried on the shaft 68. The clutch is operated to rotate the shaft 68 with the sprocket 66 when it is activated by the timer, which drives chain 70 and sprocket 72. Sprocket 72 has twice as many teeth as sprocket 66 and therefore there is a 2 to 1 speed reduction. The sprocket 72*a* shown in FIG. 3 drives chain 94 which drives sprocket 96. The drive from shaft 74 to the shaft 76 is through a vertical right angle drive 109 which drives the shaft 76 of the Geneva mechanism at one half the revolutions of the shaft 68. This makes it possible to permit the machine to operate with a four station Geneva whose input shaft turns through 180°. This means that there will be time to permit a 45° rotation of the Geneva mechanism to allow for forming mold 84 of forming mechanism B to drop down sufficiently to clear the pockets which are to be formed in the plastic and still leave another 45° motion for the platen to rise back again for the next operation. This is an improvement over the standard single follower Geneva mechanism for requirements of this sort which would require an input rotation of 360° of which 45° would be required for the platen to lower, 90° for the output of the Geneva to index, and 45° for the platen to rise. 180° would be wasted so that no useful function could be performed thereby slowing down the machine. The upward and downward movement of platen 84 is effected by cam 50 and a similar movement is effected to a platen 108 of the sealing mechanism, generally designated D, by cam 92.

Figure 7:
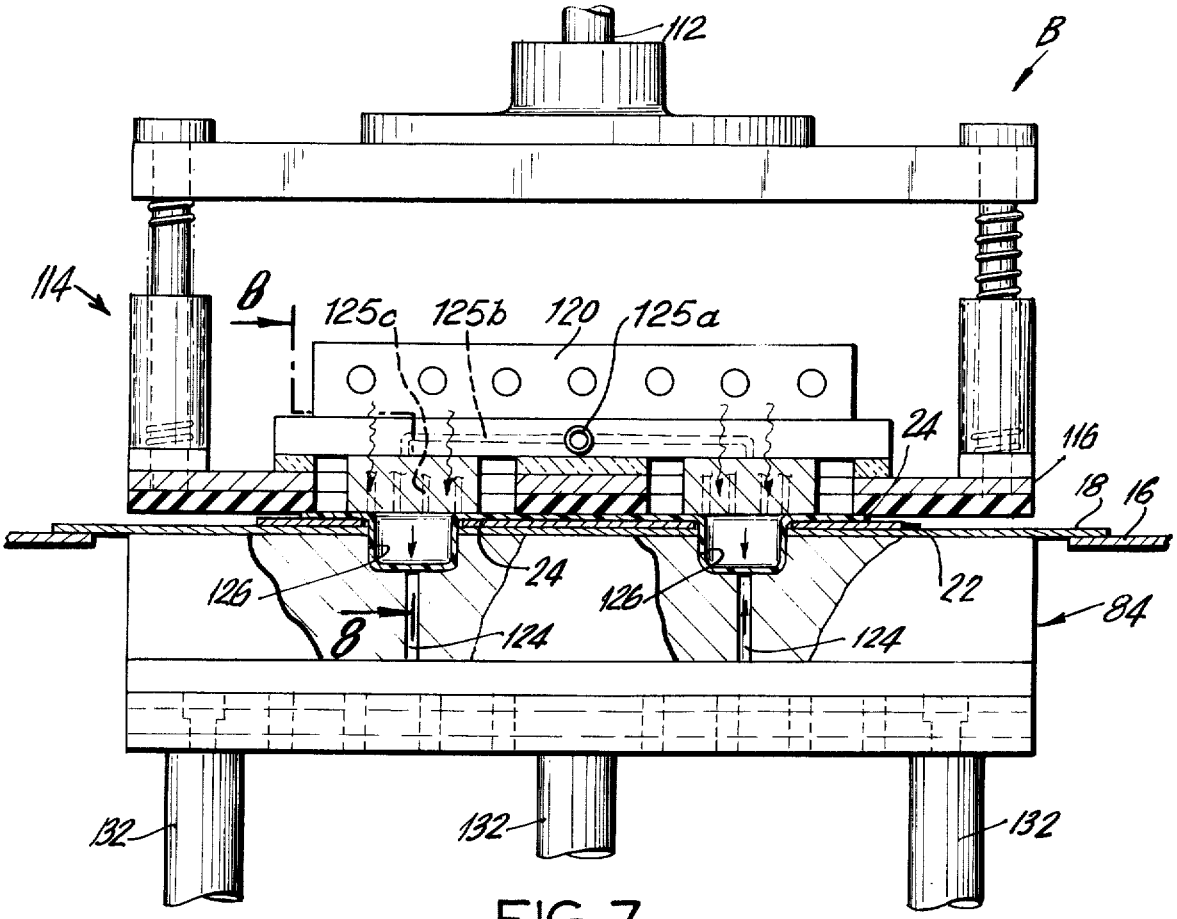
FIG. 7 is a section taken along the line 7—7 of FIG. 1.
Figure 9:
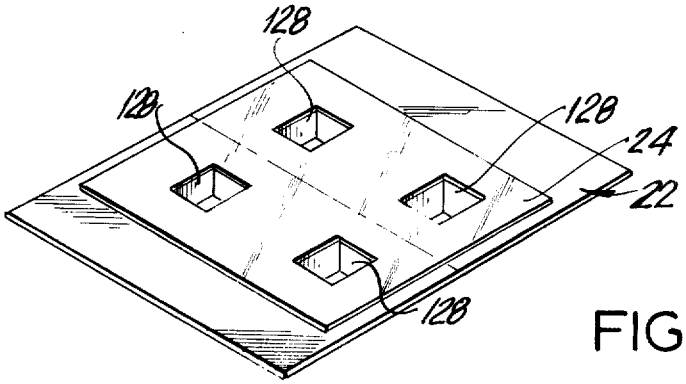
FIG. 9 is a top plan view of an open card blank and plastic sheet with formed pockets.

The forming station B includes a fluid pressure-operated piston and cylinder combination, generally designated 110, which includes a connecting rod 112 connected to a heater platen assembly 114 for moving it upwardly and downwardly in respect to the table 16. The assembly 114 includes a plate part 116 which is movable downwardly with the rod 112 against platen 84 to engage over plastic sheet 24 and carrier holder 18. Heat from heater 120 heats the plastic sheet 24 and, during this time, air is directed through a passage 124 in an upward direction to keep the film in contact with the underside of the heater. Thereafter, as shown in FIG. 7, a negative pressure is applied to the conduits 124 so that cavities 126 are evacuated and a downwardly extending blister or pocket is formed. The atmospheric or air pressure pushes from the top through upper platen conduits 125a, 125b and 125c to cause the plastic to form individual pockets 128 as shown in FIG. 9.

After pockets 128 are formed, piston rod 112 is moved upwardly by applying pressure in a conduit 130 and removing it from conduit 122 of the fluid pressure cylinder combination 110. In addition, the cam 50 is moved to permit the forming die platen 84 to drop downwardly at least by an amount sufficient to permit the top of forming mold 84 to clear the bottom of pockets 128 which are formed. Spacers 132 are associated with the platen 84. Thereupon the Geneva drive is effective to index the table 16 in order to position the carrier holder 18 at the next station or position, generally designated C, which is the station at which the pockets are loaded with a product or an article. At station C, a product 134 is dropped into each of the pockets which is on the outboard side of the score line 22a. This may be done automatically by an article loading device or by an operator located at station C.

Figure 10:
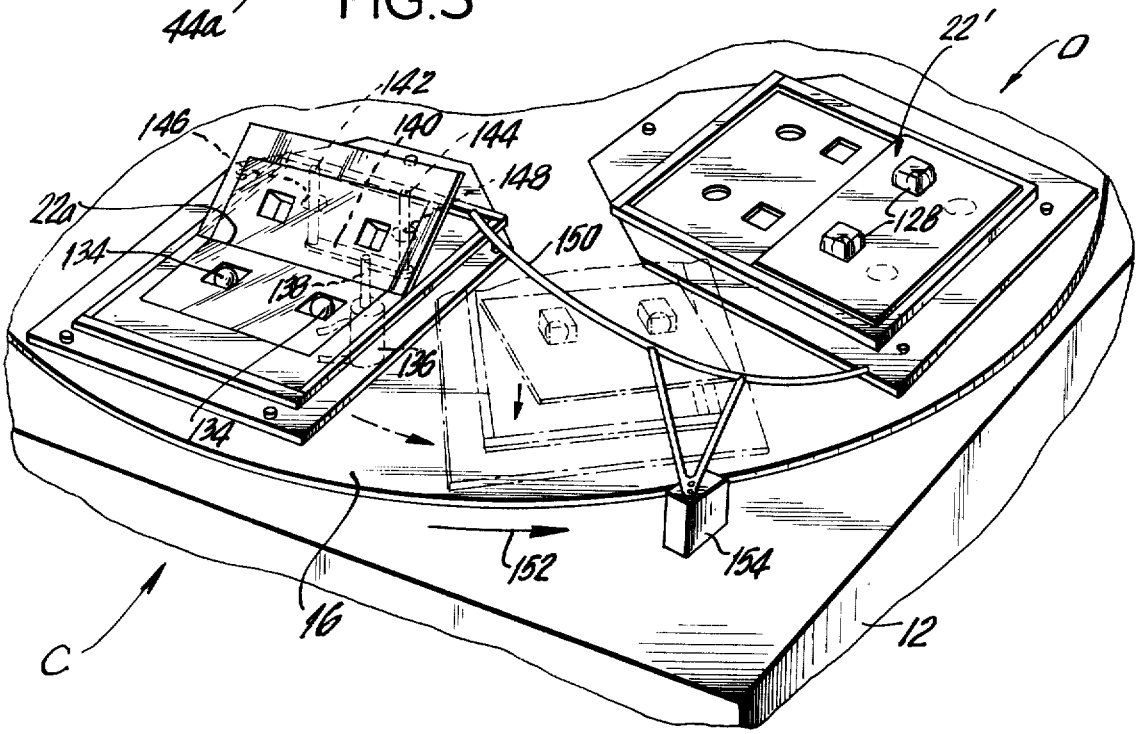
FIG. 10 is a front top partial perspective view of the machine shown in FIG. 1 indicating the apparatus for folding the card of FIG. 9.

In accordance with a feature of the invention, when the Geneva drive begins moving table 16 beyond station C, pressure is applied in a fluid pressure operated cylinder 136 to cause movement of a rod 138 connected to a cross-member 140 upwardly. Cross-member 140 carries upright pins 142 and 144 which move upwardly through openings 146 and 148 in the holder 18 which are located on the inboard side of the fold line 22*a* of the carrier card 22. This effects lifting of the inboard portion of the carrier card 22 so that this portion is shifted upwardly sufficiently to engage outboard of a flap folding plow 150. The movement of the table in a direction of the arrow 152, as shown in FIG. 10, thereupon causes the lifted portion of a card blank to be folded completely over and on top of the other portion and to cover the pockets having the article therein. In the case of a see-through pocket as in accordance with the embodiment of the invention shown, the pockets on the other part overlie the pockets on the first part in the completely folded position which is assumed at the sealing and removal station, generally designated D. The flap folding plow 150 is mounted on a bracket 154 of the frame 12.

The sealing station D, as best seen in FIG. 4, is provided with a fluid pressure operated cylinder 156 and is effective when pressure is admitted through a line 158 to lower a connecting rod or piston rod 160 to lower a top plate portion 162 which engages over the folded card package 22 which arrives on top of a sealing die mold 108 in the folded condition shown in FIG. 10. The plate 162 carries a sealing die 164 which seals the card 22 and the plastic sheet to seal-close the pockets with the product therein.

Figure 11:
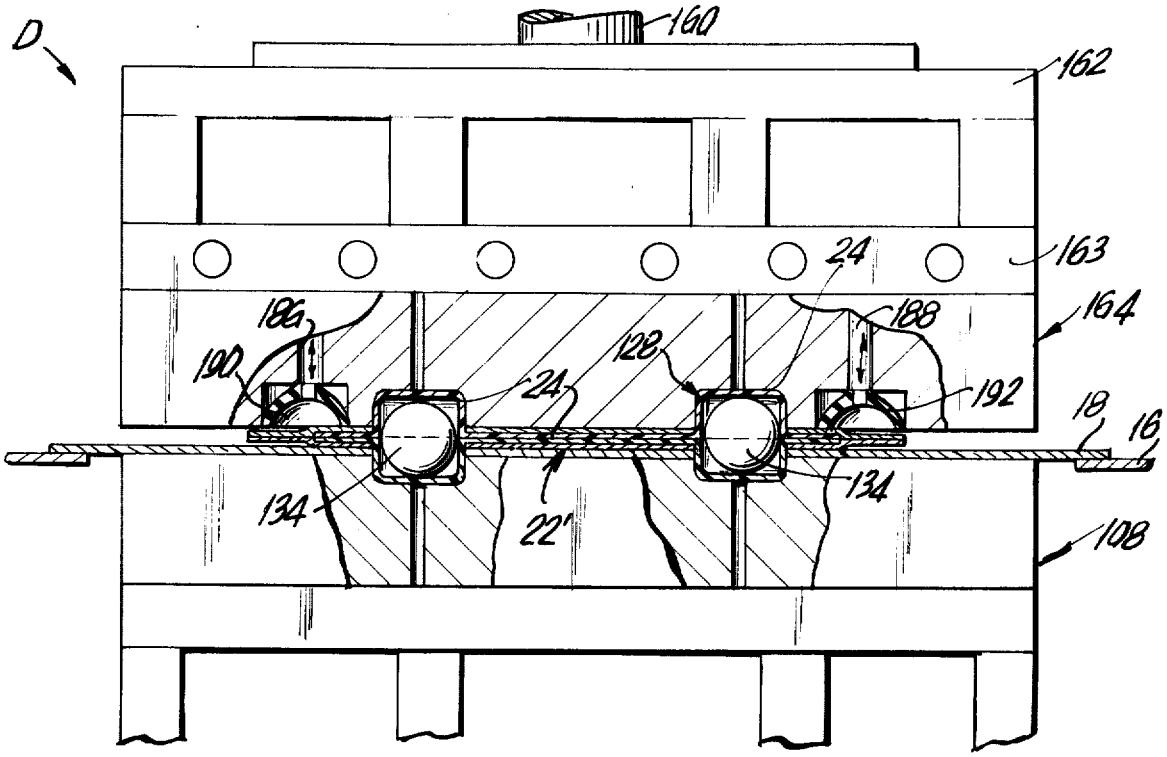
FIG. 11 is a section taken along the line 11—11 of FIG. 1.
Figure 12:
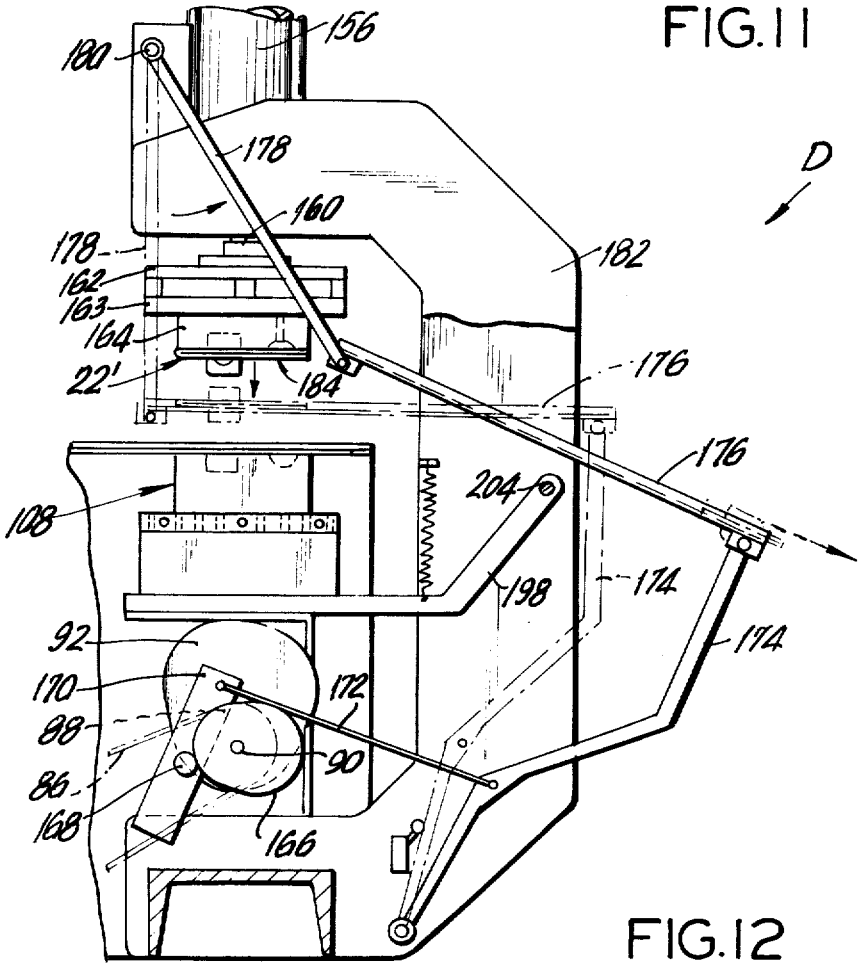
FIG. 12 is a partial elevational and partial sectional view of the product take off mechanism.

The sealing and take-off station D receives the folded blank with the product 134 located within the pockets 128 as shown at 22' in FIG. 10. Folded blank 22' is then engaged as shown in FIGS. 11 and 12 between a top platen 164 and a bottom platen 108. Top sealer 164 carries a heater 163 and by a combination of pressure and heat, it seals the board 22' and the plastic sheet 24 which has been formed into pockets 128 around the periphery of the pockets and to the board 22'. The sealing operation is generally carried out at the same time as the heating-forming operation and each are initiated by the movement of the cams 50 and 92. The switch 106 times the operation of the single revolution clutch which, when activated, rotates the chain train including chains 70, 94 and 86. Cam shaft 90 also includes a take-off cam 166 which is engageable with a follower 168 on a swinging arm 170 which is part of a parallel linkage which also includes links 172 and arms 174. The arm 174 is part of an elongated arm which is pivoted to a combined cross-link member and delivery chute 176. The opposite end of delivery chute 176 is suspended on an arm 178 which is pivoted at 180 to a U-shape support 182 of the machine frame. Chute 176 is moved from the solid line position, shown in FIG. 12, to the dotted line position shown in this figure and after elevation of the top platen 164, it is in a position between the top platen and the lower platen 108. In order to remove the now completed package 184, the top sealer 164 is provided with suction passages 186 and 188 which communicate with the interior of suction cups 190 and 192, respectively. Only two such suction cups 190 and 192 and associated passages 186 and 188 are indicated, but any number such as three or more may be provided to engage and pick up the sealed card 22' which becomes the package 184 and to lift it up with it above the holder 18. When it is in the upper position shown in FIG. 12, the vacuum is released and air pressure is applied to the cups so that the package is permitted to drop downwardly onto the receiving chute 176. Further movement of the cam 166 causes the chute to be tilted to the solid line position in which the product 184 is dumped off to a discharge conveyor or similar device for packaging or stacking.

In accordance with a feature of the invention, both the lower form mold 84 of the forming station B and the lower seal mold 108 of the sealing station D are carried on angle support arms 196 and 198, respectively, which are pivoted at a U-shape frame member 200 at pivot 202 in respect to the arm 196 and at 204 on the U-shape frame member 182 in the case of the sealing mechanism. The pivot points 202 and 204 are located below the card position, for example, at 1¼ inches in order that when the platens are lowered, the lateral shifting motion is minimized preventing an interference with the pockets which have been formed. The sealing station D may effect the heat sealing of the top of the card 22 or the top and the bottom of the card simultaneously, as desired.

The heater 163 at the sealing station D, may advantageously comprise radio frequency generated heaters preferably of a type which is modular wherein the power supply or the oscillator sections can be moved and replaced by plugging them in or out.

The operation of the device is as follows:

The stack of cards 26 are preferably each provided with a central score or fold line 22*a* and with window cut-outs 22*c* and 22*c'* on one side of the score line and cut-outs 22*b* and 22*b'* on the opposite side. A plastic sheet 24 is either previously associated with each card, such as by spot-sealing it thereto so as to overlie the window openings or it is separately fed onto the card or placed onto the card manually after it is dropped onto a card carrier or holder 18 which is defined on the rotatable carrier table 16. The drive motor 54 is switched on and it causes a continuous rotation of reducer shaft 60. The forming station B is advantageously provided with a control box 206 which has a timer 208 which may be set for controlling the operation of the output shaft 68 of the single revolution clutch. The control box also includes suitable controls, generally designated 210, for starting and stopping, for vacuum regulation, for heating and for indexing.

When the machine starts operation, the cards are fed off from the stack 26 one-by-one at a timed speed so that they are placed one after the other into the holders 18 as each in succession is indexed past the feeding station A. The card take off system at the station D is mechanically driven in timed relationship to the feeding station A so that as each card is completed, it is removed from carrier holder 18 after it arrives at the sealing and removal station D substantially at the same time as a new card is being fed into station A.

The drive of the machine includes a four position 180° Geneva drive in which there is a vertical right angle drive 109 between shaft 74 and vertical shaft 76. The output of the Geneva drive is connected to a 44 inches diameter horizontal aluminum disc of table 16 which is supported at the center by the Geneva drive shaft 82 and at the edges by Teflon pads on a table top. Each revolution of the clutch shaft 68 turns the input of the Geneva drive 180° causing the table 16 to rotate one-fourth of a turn or 90°. Each of the cams 50 and 92 are rotated one revolution or 360° upon revolution of the clutch shaft 68. The card feeder mechanism, as shown in FIGS. 5 and 6, is driven from the shaft 44 so that it turns one revolution for each revolution of the clutch to operate the feeding mechanism for the cards. The card feeder suction cups 32*a* and 32*b* then pick off a set (or one) of cards from the card stack 26 and place it on the carrier 18.

Figure 8:
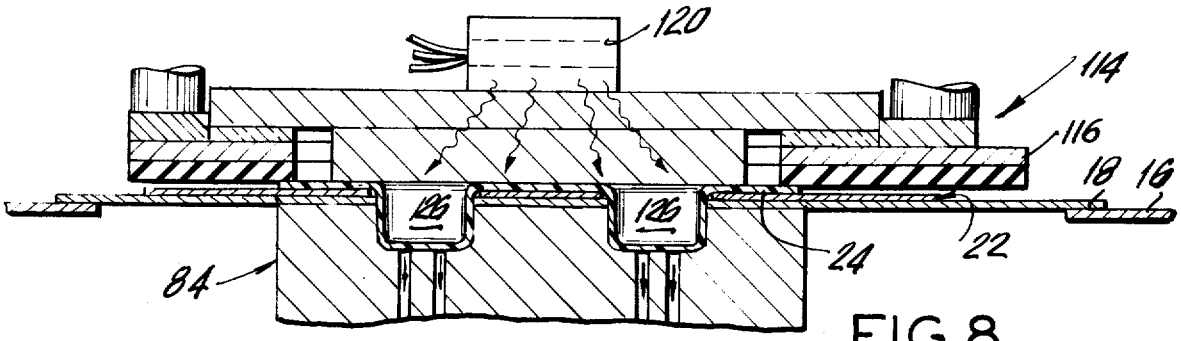
FIG. 8 is a section taken along the line 8—8 of FIG. 7.

When the table 16 is indexed one position, the carrier 18 is shifted from card feeding station A to the pocket forming station B and at this station, the cam 50 effects the raising of the forming mold 84 and the cylinder 110 is actuated to lower the platen 116. Thereupon, the formation of the pockets is effected, as indicated in FIGS. 7, 8 and 9. Four pockets 128 are formed in each of the cards in the embodiment indicated. The heating in combination with the vacuum and air flow permit the formation of the pockets readily and easily.

After the pockets are formed, the card holder is moved to the next station C at which a product 134 is either loaded manually or automatically. Upon a further movement of table 16, the carrier 18 moves from the station C to station D and, during this time, the card is automatically folded along fold line 22*a* so that the pockets in the window openings become superposed to form a see-through blister package. The folding operation is best indicated in FIG. 10 and is carried out by the upward movement of the pins 142 and 144 and by the folding plow 150 which engages the backside of the card and forces it down onto the other portion of the card until the card eventually arrives at the station D in a fully folded condition.

At station D, the cam 92 causes the upward movement of lower platen 108 and the fluid pressure cylinder 156 is actuated to lower the upper platen 164. The heat sealing is effected by heater 163 and the upper sealer 164, is lifted above the lower platen and the cam 166 effects movement of the take off mechanism to position the delivery chute 176 in alignment with the card which now forms a package 184 which is delivered off the end of the delivery chute 176 after it is inclined backwardly out of the way of sealer 164 and holder 18. Heater 163 and sealer 164 may be replaced by a Radio Frequency Generator Electrode to effect a rapid seal. Cam 166 which drives the take off unit is rotated one revolution for each revolution of the clutch shaft 68 and each revolution of this cam causes the take off unit to move between the raised top sealing platen and the bottom platen 108, to receive the product 184 and to return into its original position while dumping the product onto a receiving platform or conveyor (not shown).

Figure 13:
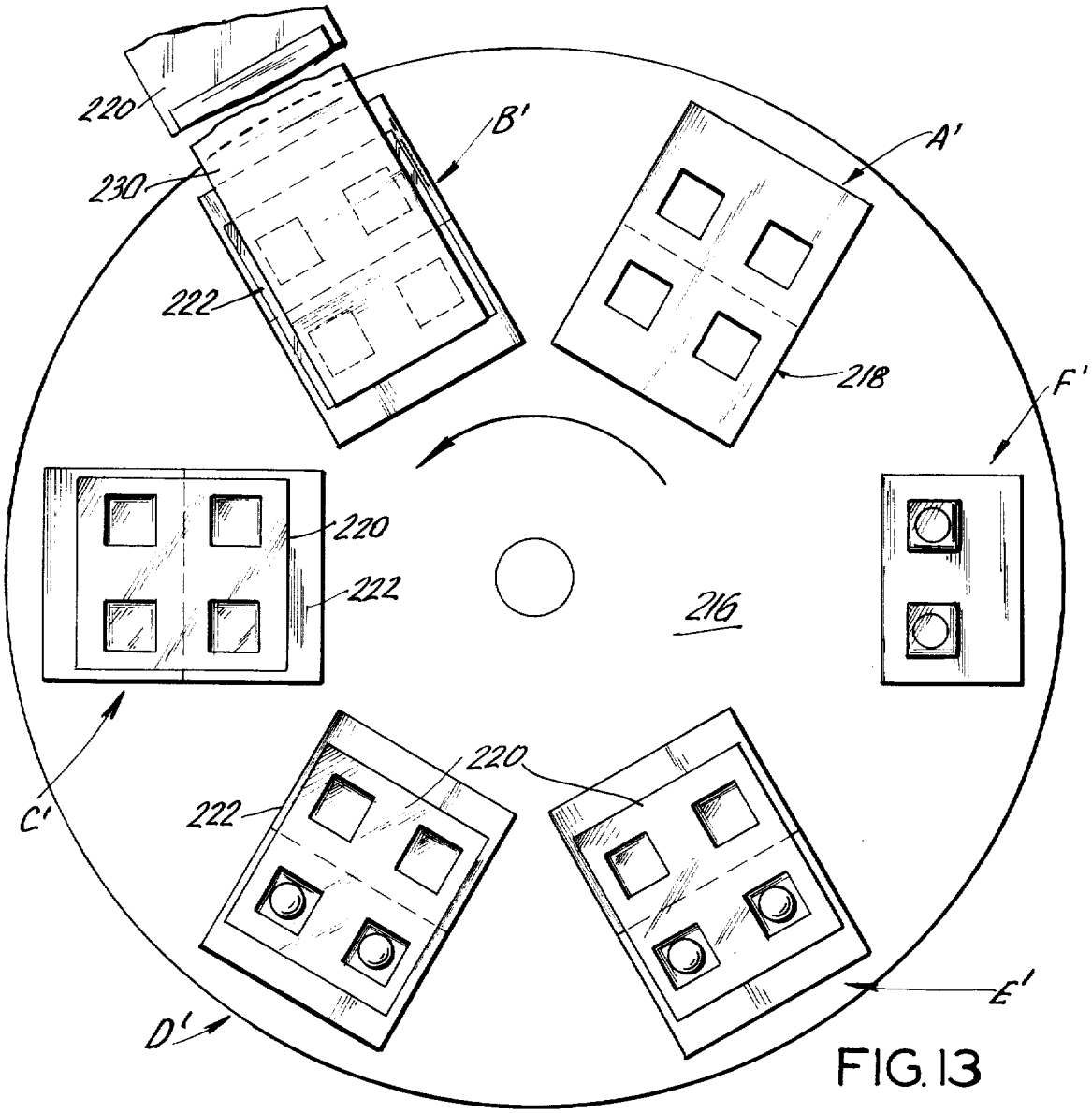
FIG. 13 is a top plan view of another embodiment of the invention showing a six station carrier.
Figure 14:
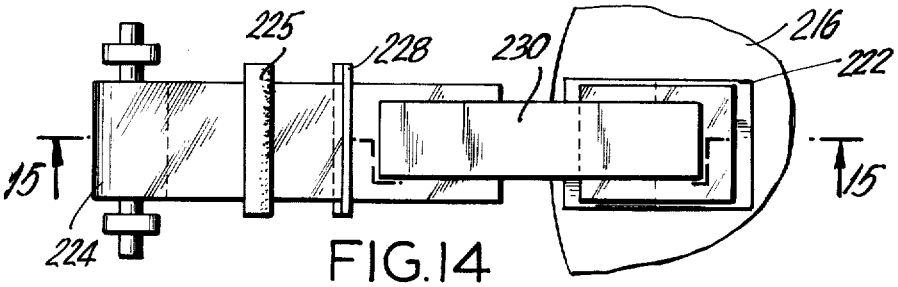
FIG. 14 is a partial reduced scale plan view similar to FIG. 13 of the plastic transfer mechanism.
Figure 15:
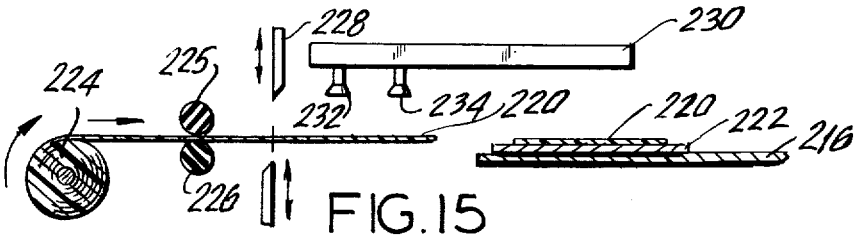
FIG. 15 is a section taken along the line 15—15 of FIG. 14.

FIGS. 13, 14 and 15 show a machine similar to FIG. 1 but with a table 216 having six separate holders 218 for the card and package which are arranged at equally spaced angular locations and which may be moved so as to be indexed into association with six different stations. Station A′ is similar to the card feed station shown in the embodiment of FIGS. 1 to 12. Station B′ is provided in order to provide a separate feed of plastic film 220 over a card blank 222 which has been fed to the carrier 218 at the station A′. For this purpose, a roll of plastic 224 is arranged in association with separate feed means including feed rollers 225 and 226 which are timed to operate with the operation of the machine and which are fed past knife means 228 to cut individual lengths of plastic 220. The individual lengths are picked up by a movable picker 230 having suction 232 and 234 which are positioned to engage the sheet in succession and to deliver it on top of the associated card 222 in time relationship to the indexing movement of the table 216. The next station, designated C′, corresponds to station B of the embodiment of FIGS. 1 through 12. Stations D′ and E′ which are indicated are provided for product loading and each corresponds to a previous station C of the first embodiment of FIGS. 1 through 12. Station F′ is similar to station D of the first embodiment.

It should be appreciated that stations such as D′ and E′ may be either both automatic loading stations or both manually operated, or one of each type, as desired. The drive mechanism for the six station embodiment is the same as the first embodiment with the exception that the Geneva drive comprises a six position member which indexes the table 216 1/6 of a revolution of 60° during each indexing movement. At station B′, the plastic 220 may be secured to the card, such as by tack heating means. While specific embodiments of the invention have been shown and described in detail to illustrate the application of the principles of the invention, it will be understood that the invention may be embodied otherwise without departing from such principles.

What is claimed is:

1. An apparatus for forming and closing a display package from a card blank having at least one window opening and which is provided with an overlying plastic sheet for forming pockets in the window openings which is adapted to be positioned to overlie the window openings and a marginal area of the card blank surrounding the opening, comprising a movable carrier for the blank and the overlying plastic sheet, means for moving said carrier through an operation path, heat forming means arranged along said operation path and operable on said plastic sheet to form a pocket in the sheet extending through the window opening of said card, said heat forming means including a movable upper platen arranged over said operational path, upper platen movement means connected to said upper platen to move it toward and away from said movable carrier for engagement and disengagement with a card thereon, a movable lower platen below said operation path, lower platen movement means connected to said lower platen to move it toward and away from said carrier for association and disassociation with a card thereon, heating means associated with said upper and lower platens for heating the plastic overlying the card in the vicinity of the window, forming means associated with said upper and lower platens for forming said plastic into a pocket bulging outwardly from said card, said apparatus further comprising product loading means and card folding means along said operation path engageable with each card in succession on the movable carrier and operable to fold said card as it is moved so that a portion thereof having said window is positioned to underlie a remaining portion thereof which is folded thereover, and sealing means along said operation path for sealing said card and said pocket.

2. An apparatus according to claim 1, wherein said forming means includes a cavity in one of said platens, means for directing fluid pressure against the plastic when in a heated condition to force it into said cavity.

3. An apparatus according to claim 2, wherein said lower platen includes a cavity therein below the window opening of said card and a passage connected to said cavity for applying predetermined pressure to the passage for regulating the attractive force and retractive force on the plastic overlying said cavity.

4. An apparatus for forming and closing a display package from a card blank having at least one window opening and which is provided with an overlying plastic sheet for forming pockets in the window openings which is adapted to be positioned to overlie the window openings and a marginal area of the card blank surrounding the opening, comprising a rotatable table for the blank and overlying plastic sheet, said table having four equally angularly spaced carrier holders therein with a frame for receiving a card blank in each; means for moving said table so that the carrier holders move through a circular operation path; card feeding means located at one angular position of said table for feeding cards into an associated holder frame; heat forming means arranged along said operation path and operable on said plastic sheet to form a pocket in the sheet; said heat forming means being located at 90° away from said card feeding means; product loading means and card folding means along said operation path engageable with each card in succession on the table and operable to fold said card as it is moved so that a portion thereof having said window is positioned to underlie a remaining portion thereof which is folded thereover; sealing means along said operation path operable to seal said sealing means being located at 90° from said card feeding means in the opposite direction from said heat forming means and being located diametrically opposite to said heat forming means; and said heat forming means and said sealing means being operable on said card blank and overlying plastic through a drive motor, first and second cam shafts underlying said heat forming means and said sealing means, each having a lifting cam thereon; said forming means including a lower platen which is engageable by one of said cams to raise said platen into a position to form a pocket in the plastic sheet and to lower said platen to a position to clear the formed pocket to permit movement of the table; said sealing means including a lower platen which is engageable by the other said cams to raise it to a sealing position and to lower it to clear the formed pockets in the card after it is sealed.

5. An apparatus according to claim 4, including a clutch connected to said drive motor, said clutch having an output portion, a vertical drive connected to said output portion of said clutch and including a feed reducing connection having an input shaft connected to said output portion of said clutch and an output shaft driven at one half the speed of said output portion of said clutch and a Geneva mechanism driven by said output shaft connected to said table for indexing said table.

6. An apparatus for forming and closing a blister package from a card blank having at least one window opening and including a plastic sheet which is adapted to be positioned on a card over the opening and a surrounding area of the card, comprising a rotatable table carrier having a plurality of holders thereon at angularly spaced relation each having a portion for receiving a card with a plastic sheet thereon, means for rotating said table to index it through a plurality of stations comparable to the number of holders on said table, a card feeding device arranged alongside said table in a position adjacent one of said holder, means at said card feeding station for feeding cards in succession onto a holder positioned therein in time relationship to the movement of said table, a card forming device located adjacent said table overlying another one of said holders at an angularly spaced location from said card feeding device, said forming means including upper and lower plates movable in opposite direction for operable engagement with said card and the plastic sheet for applying heat thereto to form the plastic sheet into a pocket, a sealing means located adjacent said table at a spaced location from said forming means and including upper and lower platens which are movable in respective opposite directions for operative engagement with a card on a carrier of said table, and folding means along said operational path engageable with each card in succession on the movable carrier and operable to fold the card as it is moved with the carrier between said forming means and said sealing means.

7. An apparatus according to claim 6, including an open space at said table between said forming means and said sealing means for loading the pockets which are formed with articles.

8. An apparatus according to claim 6, wherein said means for moving said table includes a rotatable forming cam shaft and a rotatable sealing cam shaft, a drive motor, means connected between said drive motor and said cam shaft for rotating said cam shafts in timed relation thereto, said forming means including an upper and lower platen, a forming cam platen on said forming cam shaft movable to engage said platen to move it into operation with said card blank and the plastic sheet and to move it out of operation and to clear said pockets, said sealing means including a lower platen which is movable upwardly and downwardly in respect to the holder on said table, said sealing cam shaft having a sealing cam engageable with said platen to raise it into position for operative engagement with the card and the plastic sheet thereon and to lower it to clear the pocket formed in the card.

9. An apparatus according to claim 6, including an article remover, said sealing means including an upper and lower platen which are movable together to engage the card at said holder and a delivery chute for directing a finished card from said sealing means, and means for interposing said delivery chute between the platens of said sealing means positioned below the upper sealing means to receive the finished product therefrom and to position said chute to one side to dump the product.

10. A device for sealing two portions of an overlapped card together which has a window on one portion with a plastic pocket therein, comprising an upper platen, a lower platen, means for moving said upper and lower platens together to engage the card, sealing means on one of said platens for sealing said card and finished card receiving means including a delivery chute, means articulating said delivery chute for movement between a position in which it extends beneath the upper platen when it is raised above said lower platen to a position at which it is inclined and to one side of said platen for the discharge of the product therefrom, and timing means connected between said upper and lower platens and to said delivery chute for moving said chute between said platens when they are raised apart to receive the article from the upper platen and to position it to one side when they are separated, said upper platen having suction means for holding said card which are releasable to drop the card onto the delivery chute.

11. An apparatus for forming and closing a display package from a card blank having at least one window opening and which is provided with an overlying plastic sheet for forming pockets in the window openings which is adapted to be positioned to overlie the window openings and a marginal area of the card blank surrounding the opening, comprising a movable carrier for the blank and the overlying plastic sheet, means for moving said carrier through an operation path, heat forming means arranged along said operation path and operable on said plastic sheet to form a pocket in the sheet extending through the window opening of said card, product loading means, and card folding means along said operation path engageable with each card in succession on the movable carrier and operable to fold said card as it is moved so that a portion thereof having said window is positioned to underlie a remaining portion thereof which is folder thereover, and sealing means along said operation path for sealing said card and said pocket; and said carrier moving means further comprising a drive motor, a clutch connected to said drive motor for rotation therewith and having an output shaft, timing means for connecting and disconnecting said output shaft of said clutch, a carrier drive shaft, a speed reducer connected to said carrier drive shaft and having an input shaft connected to the output shaft of said clutch and driving said carrier drive shaft at one half the speed of rotation of the output shaft of said clutch, said carrier drive shaft including a Geneva mechanism connected to said carrier to index said carrier.

12. Apparatus for forming and closing a display package from a card blank having at least one window opening therein covered by a plastic sheet which overlies the window opening and at least a marginal portion of the card blank surrounding the window, comprising:

a. A rotatable table;

b. means for indexing the table through a multiple of angularly spaced fixed positions;

c. means on the table for receiving and holding the card blanks and associated plastic sheets;

d. a multiple of operating stations disposed in angularly spaced fixed locations around the table;

e. means for feeding the card blanks with overlying plastic sheets one at a time from a first operating station in timed relation to the indexing of the table so that one card is fed into each receiving and holding means while the table is stationary after being indexed;

f. means for heating the overlying plastic sheet and forming it into pockets extending through the window openings, at a second operating station and operable on each card blank and associated plastic sheet in timed relation while the table is stationary, after being indexed, said heating and forming means including upper and lower platens movable into and out of engagement with a card blank and associated plastic sheet both for applying heat to the plastic sheet and for forming it into a pocket extending through the window opening while the table is stationary;

g. means for folding the card blank and associated plastic sheet;

h. means for heat sealing the card, after it is folded, at another operating station and operable on the folded card in timed relation while the table is stationary after being indexed, said sealing means including upper and lower platens which are movable into and out of operative engagement with a card blank and associated plastic sheet.

13. Apparatus for forming and closing a display package from a card blank havng at least one window opening therein, and from a plastic sheet adapted to overlie the window opening and a marginal portion of the card blank surrounding the window, comprising:

a. a rotatable table;

b. means for indexing the table through a multiple of angularly spaced fixed positions;

c. means on the table for receiving and holding the card blanks and associated plastic sheets;

d. a multiple of operating stations disposed in angularly spaced fixed locations around the table;

e. means for feeding the card blanks one at a time from a first operating station in timed relation to the indexing of the table so that one card is fed into each receiving and holding means while the table is stationary after being indexed;

f. means for feeding the plastic sheet from a second operating station onto the card blanks, in timed relation to the indexing of the table so that each card in succession is provided with a plastic sheet while the table is stationary after being indexed;

g. means for heating the overlying plastic sheet and forming it into pockets extending through the window openings, at a third operating station and operable on each card blank and associated plastic sheet in timed relation while the table is stationary, after being indexed, said heating and forming means including upper and lower platens movable into and out of engagement with a card blank and associated plastic sheet both for applying heat to the plastic sheet and for forming it into a pocket extending through the window opening while the table is stationary;

h. means for folding the card blank and associated plastic sheet;

i. means for heat sealing the card, after it is folded, at another operating station and operable on the folded card in timed relation while the table is stationary after being indexed, said sealing means including upper and lower platens which are movable into and out of operative engagement with a card blank and associated plastic sheet.

* * * * *